US010760262B2

(12) United States Patent
Rim

(10) Patent No.: US 10,760,262 B2
(45) Date of Patent: Sep. 1, 2020

(54) CONSTRUCTION STRUCTURE OF GEODESIC DOME-SHAPED HOUSE AND CONNECTION STRUCTURE BODY THEREOF

(71) Applicant: Seon Dong Rim, Chungcheongbuk-do (KR)

(72) Inventor: Seon Dong Rim, Chungcheongbuk-do (KR)

( * ) Notice: Subject to any disclaimer, the term of this patent is extended or adjusted under 35 U.S.C. 154(b) by 0 days.

(21) Appl. No.: 16/469,232

(22) PCT Filed: Dec. 13, 2017

(86) PCT No.: PCT/KR2017/014602

§ 371 (c)(1),
(2) Date: Jun. 13, 2019

(87) PCT Pub. No.: WO2018/110957

PCT Pub. Date: Jun. 21, 2018

(65) Prior Publication Data

US 2019/0382998 A1 Dec. 19, 2019

(30) Foreign Application Priority Data

Dec. 13, 2016 (KR) ..... 10-2016-0169285
Dec. 15, 2016 (KR) ..... 20-2016-0007297 U

(51) Int. Cl.
*E04B 1/32* (2006.01)
*E04B 1/41* (2006.01)

(52) U.S. Cl.
CPC ..... *E04B 1/3211* (2013.01); *E04B 1/40* (2013.01); *E04B 2001/3223* (2013.01); *E04B 2001/3247* (2013.01); *E04B 2001/3252* (2013.01)

(58) Field of Classification Search
CPC .. E04B 1/3211; E04B 1/40; E04B 2001/3223; E04B 2001/3247; E04B 2001/3252
See application file for complete search history.

(56) References Cited

U.S. PATENT DOCUMENTS 3,058,550 A * 10/1962 Richter ..... E04B 1/3211 52/222
3,137,371 A * 6/1964 Nye ..... E04B 1/3211 52/81.2

(Continued)

FOREIGN PATENT DOCUMENTS

KR 1020000036967 7/2000
KR 2002234560000 2/2001

(Continued)

*Primary Examiner* — James M Ference
(74) *Attorney, Agent, or Firm* — IPLA P.A.; James E. Bame

(57) ABSTRACT

A construction structure of a geodesic dome-shaped house and a connection structure body thereof comprises: a plurality of triangular unit modules constituting a unit structure and a connection structure body of a geodesic dome-shaped house; a pair of inner beams which are disposed on both opposing sides of the triangular unit module; a connector which is disposed in a corner area between the pair of inner beams and connected to the pair of inner beams by a first coupling member; and a pair of outer beams which are disposed on outer surfaces of the pair of inner beams, respectively and connected to the connector and the inner beams by a second coupling member.

8 Claims, 7 Drawing Sheets

(56) References Cited

U.S. PATENT DOCUMENTS 3,192,669 A * 7/1965 Hawkins ..... E04D 3/08 52/81.3
3,486,278 A * 12/1969 Woods ..... E04B 1/3211 52/81.3
3,660,952 A * 5/1972 Wilson ..... E04B 1/10 52/81.4
3,844,074 A * 10/1974 Ahern ..... E04B 1/1903 52/81.4
3,844,664 A * 10/1974 Hogan ..... E04B 1/1903 403/171
3,857,212 A * 12/1974 Barnett ..... E04B 1/3211 52/81.3
3,916,589 A * 11/1975 Richter ..... E04B 1/3211 52/81.3
3,945,160 A * 3/1976 Grosser ..... E04B 7/105 52/81.4
4,009,543 A * 3/1977 Smrt ..... E04B 1/3211 52/81.2
4,260,276 A * 4/1981 Phillips ..... E04B 1/2403 403/172
4,262,461 A * 4/1981 Johnson ..... E04B 1/3211 52/81.3
4,491,437 A * 1/1985 Schwartz ..... E04B 1/3211 403/172
4,521,998 A * 6/1985 DeLorme ..... E04B 1/1903 403/170
4,534,672 A * 8/1985 Christian, III ..... E04B 1/1903 403/126
4,542,759 A * 9/1985 Kyner, Jr. ..... E04B 1/3211 135/122
4,566,818 A * 1/1986 Schwartz ..... E04B 1/1909 403/172
4,611,441 A * 9/1986 Wickens ..... E04B 1/3211 52/81.4
4,621,467 A * 11/1986 Golden ..... E04B 1/3211 52/309.9
4,663,898 A * 5/1987 Yacaboni ..... E02D 27/42 52/167.1
4,720,947 A * 1/1988 Yacaboni ..... E02D 27/42 52/167.1
4,729,197 A * 3/1988 Miller ..... E04B 1/3211 403/172
4,904,108 A * 2/1990 Wendel ..... E04B 1/1912 403/170
5,031,371 A * 7/1991 Davister ..... E04B 1/10 403/170
5,379,557 A * 1/1995 Kotter ..... E01F 8/0023 52/591.2
5,430,989 A * 7/1995 Jones ..... E04B 1/1903 403/171
5,611,187 A * 3/1997 Jones ..... E04B 1/1903 403/122
6,708,455 B1 * 3/2004 Niiduma ..... E04B 1/3211 52/81.2
2006/0117675 A1 * 6/2006 Herrmann ..... B64B 1/08 52/81.1
2006/0291952 A1 * 12/2006 Wood ..... E04B 1/3211 403/217
2008/0066393 A1 * 3/2008 Sorensen ..... A63H 33/101 52/81.1
2009/0019790 A1 * 1/2009 Garofalo ..... E04C 2/328 52/81.3
2009/0056239 A1 * 3/2009 Wolfram ..... E04B 1/3211 52/81.3
2011/0162310 A1 * 7/2011 Garofalo ..... E04B 1/3211 52/578
2019/0382998 A1 * 12/2019 Rim ..... E04B 1/3211

FOREIGN PATENT DOCUMENTS

KR 1020090121994 11/2009
KR 1012379000000 2/2013
KR 1014147900000 6/2014

* cited by examiner

[Fig. 1]
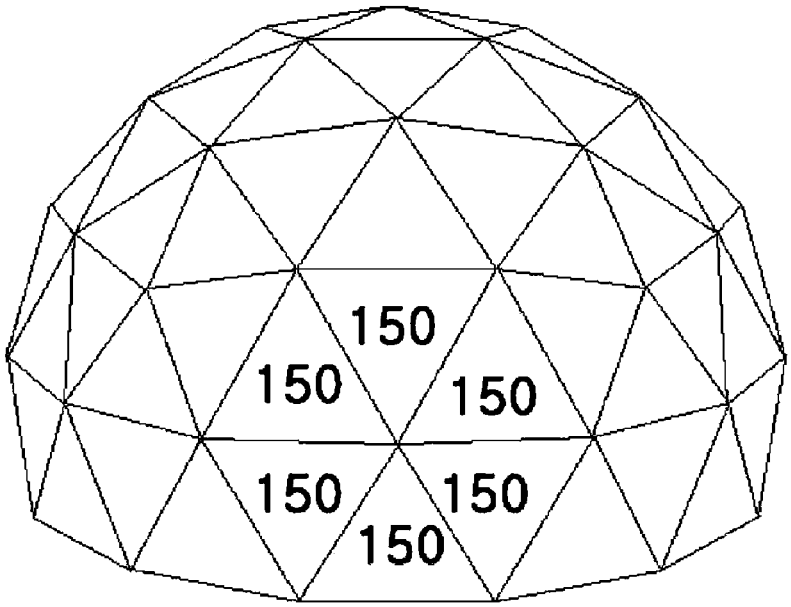
[Fig. 2]
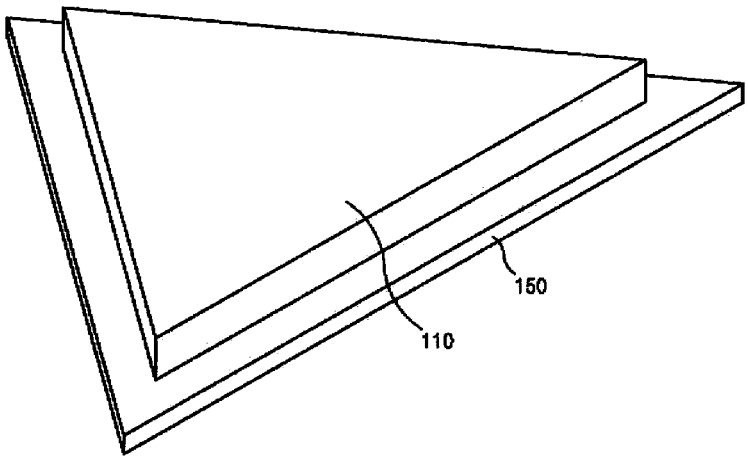

[Fig. 3]
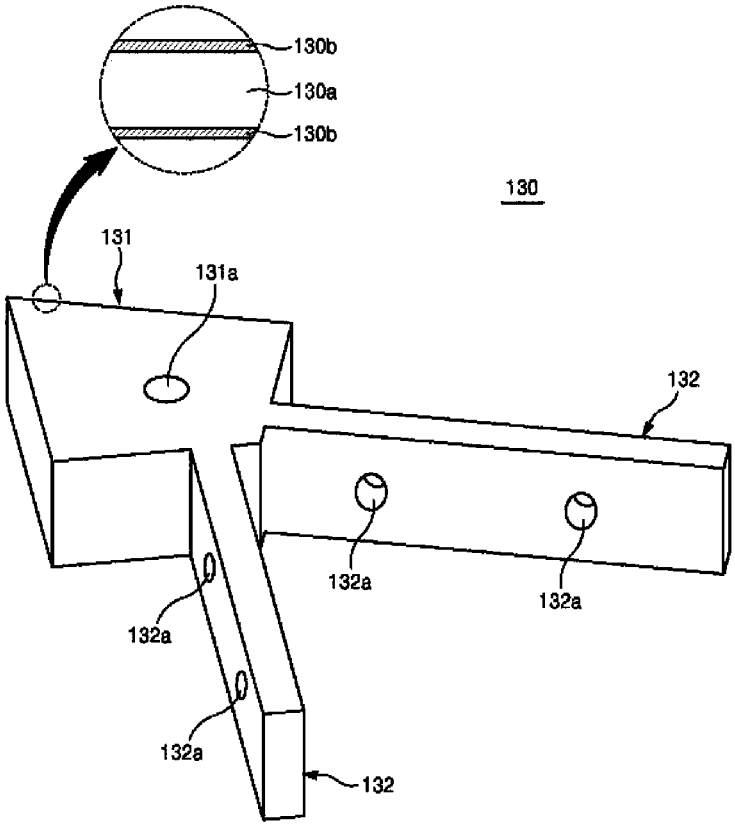
[Fig. 4]
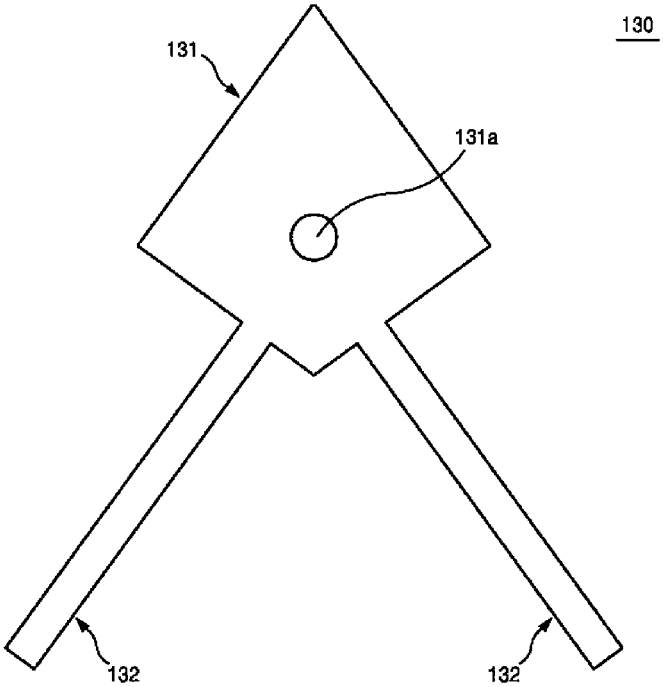

[Fig. 5]
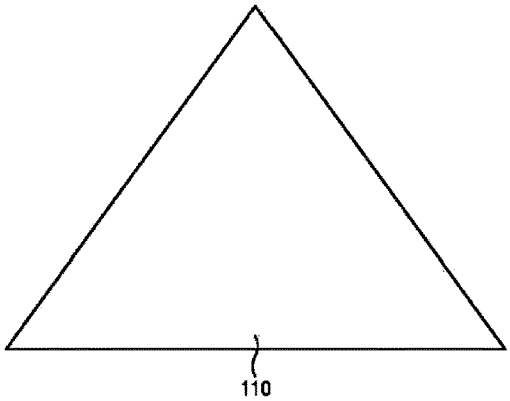
[Fig. 6]
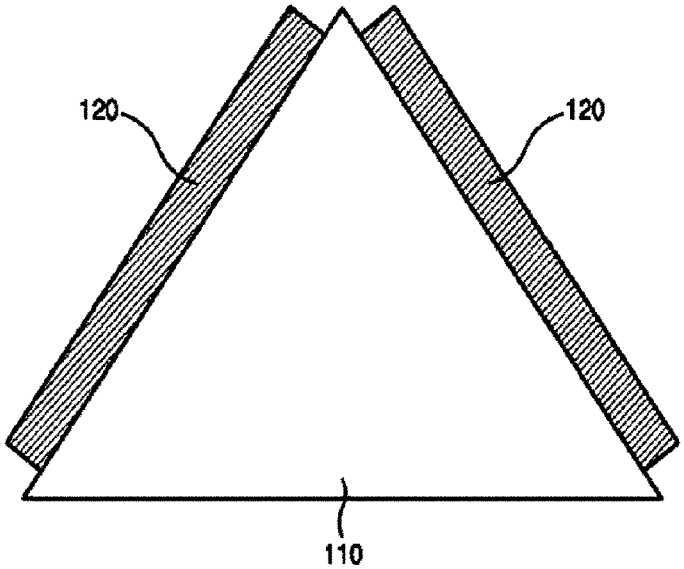
[Fig. 7]
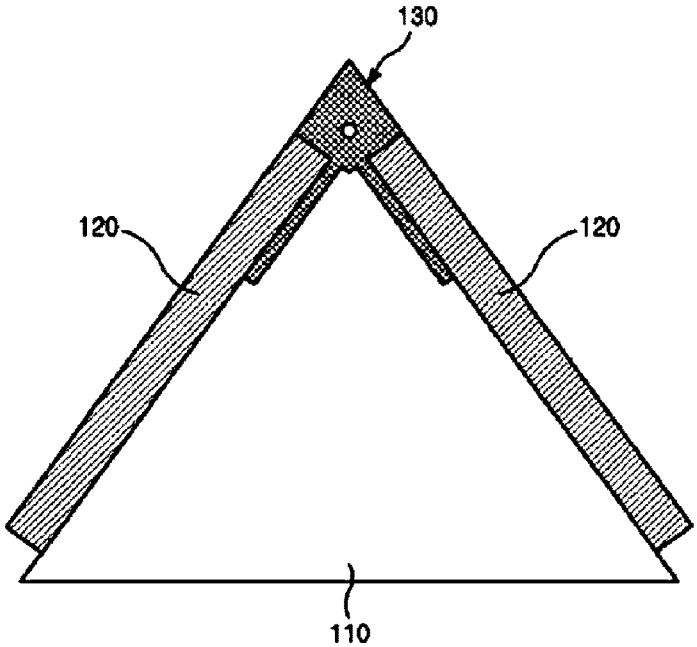

[Fig. 8]
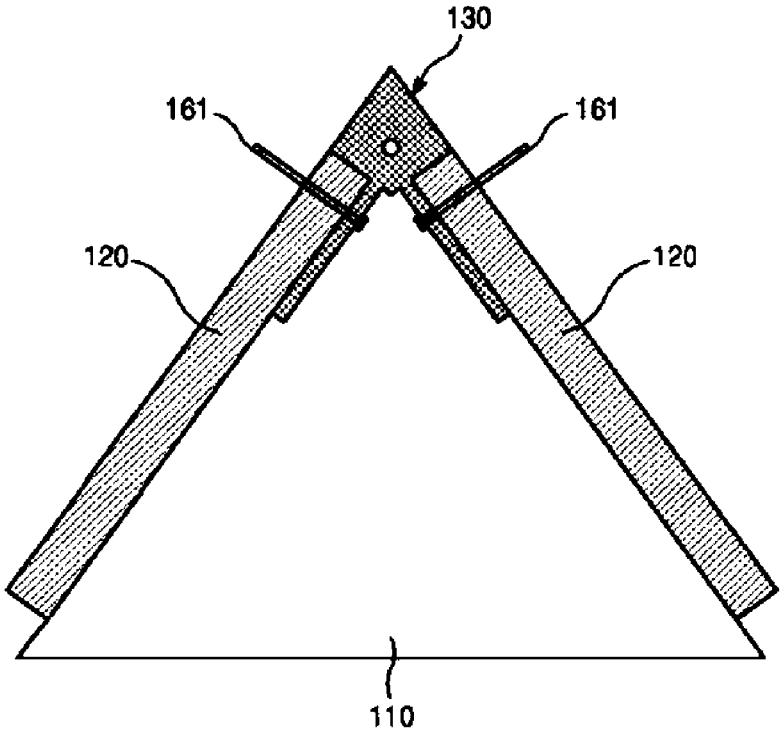
[Fig. 9]
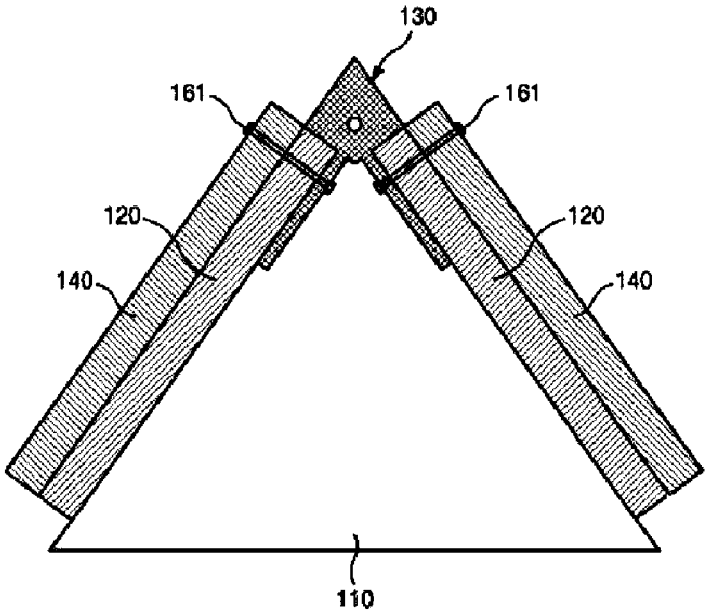

[Fig. 10]
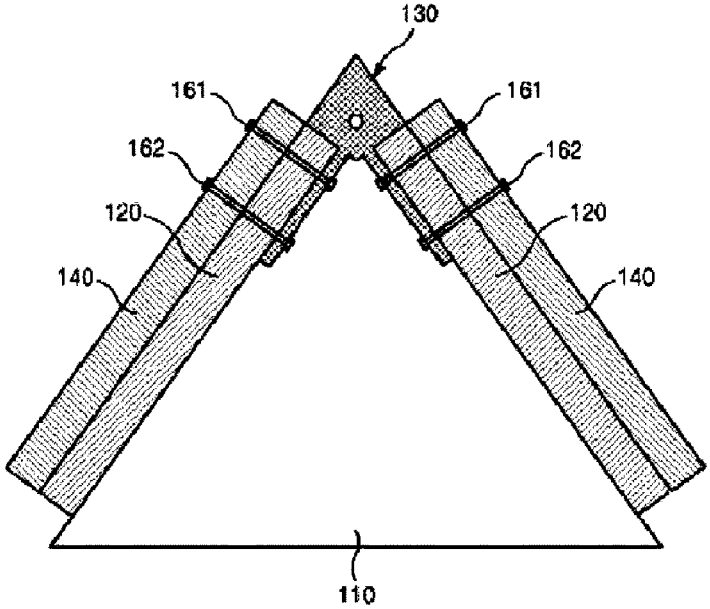
[Fig. 11]
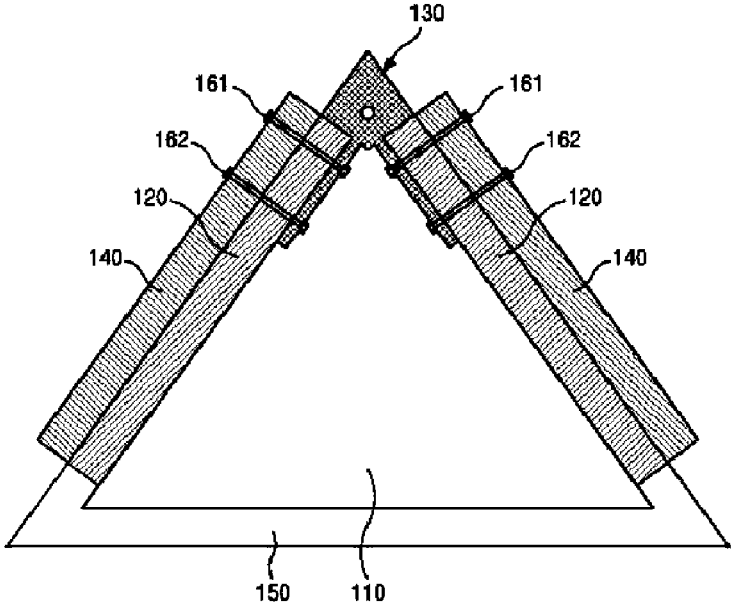

[Fig. 12]
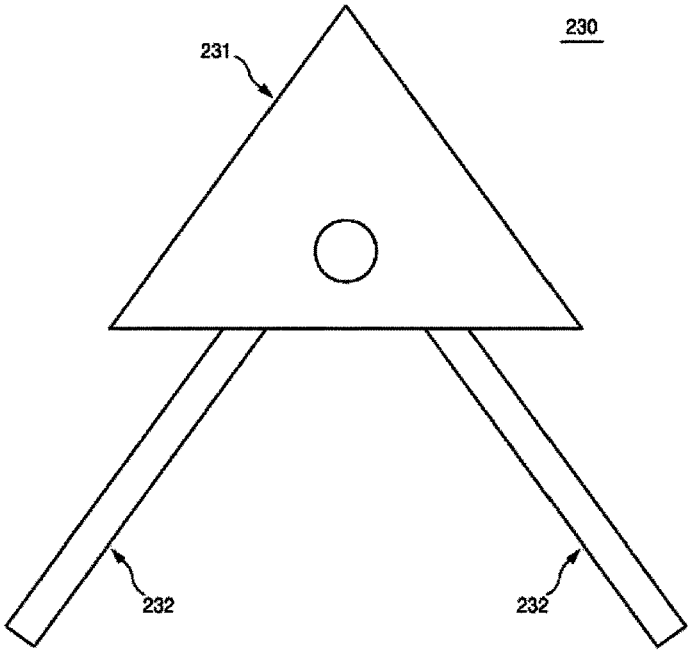
[Fig. 13]
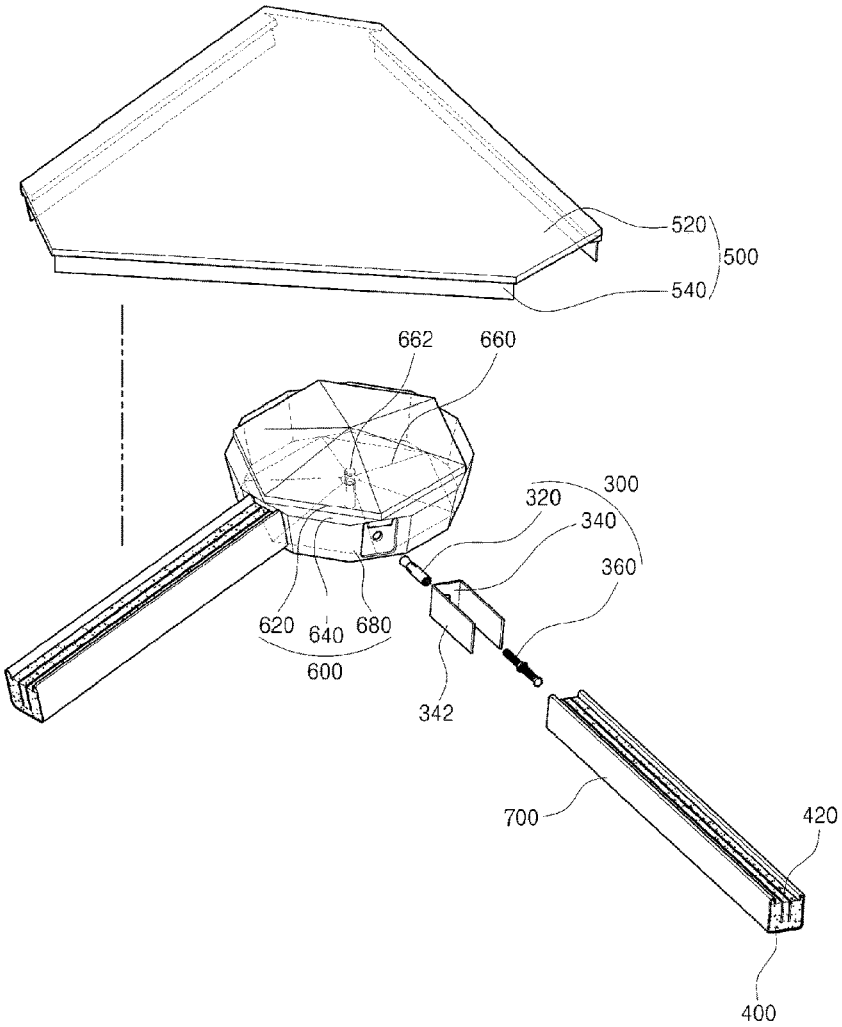

[Fig. 14]
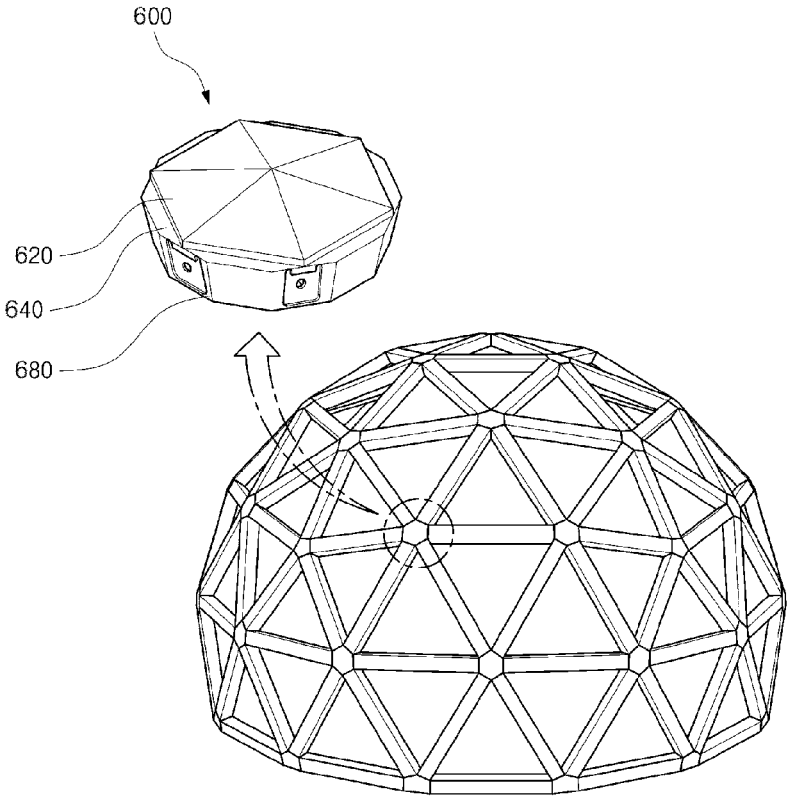
[Fig. 15]
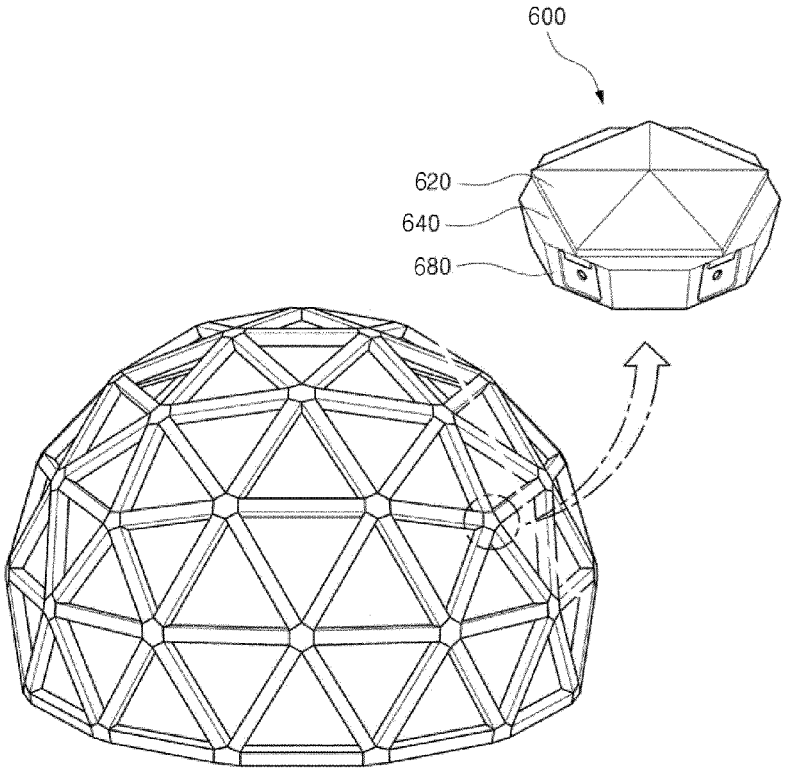

CONSTRUCTION STRUCTURE OF GEODESIC DOME-SHAPED HOUSE AND CONNECTION STRUCTURE BODY THEREOF

BACKGROUND

The present invention relates to a construction structure of geodesic dome-shaped house and connection structure body thereof, more particularly, to a construction structure of geodesic dome-shaped house and connection structure body thereof, in which a simple and compact connector is used so that it is possible to reduce the construction process, thereby reducing the construction time and lowering the construction cost, and further widening the choice of the exterior finishing material.

The soccer ball looks like a sphere, but it is actually made by stitching and connecting leathers in the form of regular pentagons and regular hexagons. Unless inflated with air, the soccer ball is merely a polyhedron.

Since the face of soccer ball consists of two types of polygons, it cannot consist of a regular polyhedron but can consist of a regular icosahedron.

Hereinafter, a method for making a soccer ball will be described. First, each corner of a regular icosahedron is divided into three equal parts and cut them off around each vertex thereof.

In this case, since each vertex has five faces, twelve regular pentagonal faces as many as the number of vertices are newly created and the original twenty regular triangular faces form a regular hexagon.

In this way, a regular icosahedron is formed with sixty vertices and ninety corners, in other words, a truncated regular icosahedron. If such a polyhedron is made with leather and put air in it, a soccer ball can be made.

As described above, a polyhedron consisting of at least two types of regular polygonal faces and is in contact with a sphere is called a quasi-regular polyhedron or Archimedes' three-dimensional figure. A truncated regular icosahedron is one of thirteen types of quasi-regular polyhedrons.

A geodesic dome also originates from a regular icosahedron. A large regular triangle is divided into equidistant triangles on each side, and then joining them into the sphere to project each vertex onto the spherical surface.

In that case, a polyhedron, all sides of which are almost the same like a regular triangle and which looks more similar to a sphere, is the structure and connection structure body of the geodesic dome.

A building using such a geodesic dome as a roof is a geodesic dome-shaped house.

Since the dome-shaped architecture does not require walls or pillars, the geodesic dome house can be freely devised for its interior design, can also be lit up by natural light, and can see the sky indoors, and thus it is widely constructed in recent times.

Such a technology is widely known in Korean Patent Application Nos. 10-2000-0017361, 10-2008-0048180 and 10-009-0026999, and Korean Utility Model Application No. 20-2000-0033153, etc.

However, in the case of prior arts including the above documents, it is difficult to construct due to limitations of structure and connection structure body such as using a somewhat complex hub connector. As such, since there are various problems such as long construction time and increase of construction cost, it is necessary to develop technologies to supplement such problems.

PRIOR ART DOCUMENTS (Patent Document 1) Korean Patent Application No. 10-2000-0017361

(Patent Document 2) Korean Patent Application No. 10-2008-0048180

(Patent Document 3) Korean Patent Application No. 10-2009-0026999

(Patent Document 4) Korean Utility Model Application No. 20-2000-0033153

(Patent Document 5) KR 10-1414790 B1

(Patent Document 6) KR 10-2012-0112300 A1

SUMMARY OF THE INVENTION

It is an object of the present invention to provide a construction structure of geodesic dome-shaped house and connection structure body thereof, in which a simple and compact connector is used so that it is possible to reduce the construction process, thereby reducing the construction time and lowering the construction cost, simply attaching a finishing panel to an exterior finish, and further widening the choice of the exterior finishing material.

In order to achieve the above purpose, the present invention provides a construction structure of a geodesic dome-shaped house, including: a plurality of triangular unit modules constituting a unit structure and a connection structure body of a geodesic dome-shaped house; a pair of inner beams disposed on both opposing sides of the triangular unit module; a connector which is disposed in a corner area between the pair of inner beams and connected to the pair of inner beams by a first coupling member; and a pair of outer beams disposed on the outer surfaces of the pair of inner beams, respectively and connected with the connector and the inner beams by a second coupling member.

An exterior finishing material which is disposed on the outside of the triangular unit module to be freely replaced may be further included.

The corner head which is in the shape of a rectangle or a triangle may be formed with a first through-hole for coupling with the exterior finishing material, and the pair of inclined legs may be formed with a second through-hole for coupling with the first and the second coupling members.

The connector may include an injection-molded body which is injection-molded with a synthetic resin; and a coating layer which is coated on the outer surface of the injection-molded body.

To achieve the above object, the present invention includes: a plurality of connecting devices; an angle disposed between each of the connecting devices; a fastening device which connects the connecting devices and the angle; and a finishing panel provided with a cover plate placed in the space between the angles adjacent to the inner material which is provided inside the angle with an coupling groove formed thereon and an insertion plate which is provided at the lower portion of the cover plate to be inserted into the coupling groove.

The fastening device includes: a nut which is protrudingly coupled to a side surface of the connecting device, a mounting plate coupled to both ends of the angle, and a bolt installed on each of the mounting plate to connect the connecting device with the angle by fastening with the nut.

The mounting plate further includes a guide plate which is in close contact with the inner side surface of the angle to guide an insertion.

The connecting device includes: an upper portion in which a plurality of triangular unit modules are formed continuously along the side surfaces thereof to form a polygonal structure, a center of which is upward and the edge thereof is downward; a stepped portion which is extended to be stepped downwardly from the edge of the upper side portion to be in close contact with the edge portion of the cover plate; a lower side portion which is formed corresponding to the lower portion of the upper side portion; and a side portion which is connected to an edge between the lower side portion and the stepped portion and forms a groove in a size corresponding to the end of the angle to be in close contact with the angle. The lower side portion, on a central portion of which a through-hole is formed to mount a nut is bolt-coupled to the nut to install an internal structure. The angle includes: a horizontal plate; a vertical plate which is extended in a vertical direction on both sides of the horizontal plate; and a bent plate which is bent downward at an end of the vertical plate to prevent the inner material from being separated.

The inner material is waterproofed by injecting silicon between the upper portion of the inner material and the finishing panel coupled to the inner material.

According to the present invention, since a simple and compact connector is used, it is possible to reduce the construction process, thereby reducing the construction time and lowering the construction cost, and further widening the choice of the exterior finishing material. To construct the dome-shaped house, the connection of the connecting device and the angle can be simply coupled by the fastening device. In addition, the finishing panel, which is the exterior of the dome-shaped house, is coupled by being inserted into the angle.

BRIEF DESCRIPTION OF DRAWINGS

FIG. 1 is a top view of one part of a geodesic dome-shaped house according to the first embodiment of the present invention.

FIG. 2 is a perspective view of a triangular unit module and an external finishing material.

FIG. 3 is a perspective view of a connector.

FIG. 4 is a front view of FIG. 3.

FIGS. 5 to 11 are a construction flow chart of the construction structure of a geodesic dome-shaped house according to the first embodiment of the present invention.

FIG. 12 is a front view of the connector used to the construction structure of a geodesic dome-shaped house according to the second embodiment of the present invention.

FIG. 13 is a perspective view of the connection structure body of a geodesic dome-shaped house according to the embodiment of the present invention FIG. 14 is a connecting device installation example of the connection structure body of a geodesic dome-shaped house.

FIG. 15 is a connecting device installation example of the connection structure body of a geodesic dome-shaped house.

DETAILED DESCRIPTION OF THE INVENTION

Hereinafter, embodiments of the present invention will be described in detail with reference to the accompanying drawings so that these can easily be carried out by those skilled in the art to which the present invention pertains.

However, since the description of the present invention is only the embodiment for structural, connection structural description, or functional description, the claims of the present invention should not be construed as being limited to the embodiments described herein.

For example, since the embodiments can be variously modified and can take various forms, the claims of the present invention should be construed as including equivalents that can realize the technical idea.

In addition, since the object or the effect suggested in the present invention does not mean that a particular embodiment should include all or only such an effect, it should not be construed as limiting the claims of the present invention.

In the present specification, the present embodiment is provided to complete the disclosure of the present invention and to fully notify the category of the invention to those skilled in the art to which the present invention pertains. The present invention is only defined by the scope of claims.

Therefore, in some embodiments, well known components, operations, and techniques are not specifically described in order to avoid ambiguous interpretations of the present invention.

Meanwhile, the terms used to describe in the present invention are not limited to the dictionary meaning, and should be construed as follows.

Throughout the specification, it will be understood that when a component is referred to as being "connected to" another component, it can be directly "connected to" the other component or other components intervening therebetween may be present. In contrast, when a component is referred to as being "directly connected to" another component, it should be construed that there is no component intervening therebetween. Meanwhile, other expressions for describing the relationship between components, such as "between" and "immediately between" or "adjacent to" and "directly adjacent to" should be also interpreted in the same manner.

The singular forms should be construed as including the plural forms, unless the context clearly indicates otherwise. It should be further understood that the term "comprises" or "have" specifies the presence of stated features, numerals, steps, operations, components, parts, or combination thereof, but do not preclude the presence or additional possibility of one or more other features, numerals, steps, operations, components, parts, or combination thereof.

Unless defined otherwise, all terms used herein have the same meaning as commonly understood by those skilled in the art to which the present invention pertains.

The terms defined in commonly used dictionaries should be interpreted to be consistent with the meanings in the context of the related art and cannot be interpreted as having ideal or excessively formal meaning unless obviously defined in the present invention.

Hereinafter, embodiments of the present invention will be described in detail with reference to the drawings. In the description of the embodiments, the same reference marks are given to the same component, and description on the same reference marks will be omitted in some cases.

FIG. 1 is a top view of one part of a geodesic dome-shaped house according to the first embodiment of the present invention, FIG. 2 is a perspective view of a triangular unit module and an external finishing material, FIG. 3 is a perspective view of a connector, FIG. 4 is a front view of FIG. 3, and FIGS. 5 to 11 are a construction flow chart of a geodesic dome-shaped house construction structure according to the first embodiment of the present invention.

Referring to these drawings, since a geodesic dome-shaped house construction structure according to the present embodiment uses a simple and compact connector, it is possible to reduce the construction process, thereby reducing the construction time and lowering the construction cost, and further widening the choice of the exterior finishing material.

To achieve such a geodesic dome-shaped house construction structure, a triangular module 110, a pair of inner beams 120, a connector 130, a pair of outer beams 140, and an external finishing material 150 are used herein.

The triangular module 110 is a member constituting a unit structure of the geodesic dome-shaped house. Referring to FIG. 1, a total of five triangular unit modules 110 are applied. An external finishing material 150 is coupled to the triangular unit modules 110.

When the triangular unit module 110 is used as in the present embodiment, it may have a stable structure since the load of the dome house can be evenly dispersed throughout beams 120, 140.

For reference, as a plurality of triangular unit modules 110 may be assembled, a connector that the shapes of a quadrilateral, a pentagon and a hexagon are combined may be formed. It is also possible to bundle the plurality of triangular modules and apply the connector of a quadrilateral, a pentagon, or a hexagon as one body.

A pair of inner beams 120 refers to beams disposed on opposing sides of the triangular unit module 110. In the case of the present embodiment, beams with rectangular cross section are used, but a circular beam or an elliptical beam may be applied.

The connector 130 is a member which is disposed in a corner area between a pair of inner beams 120 to connect with the pair of inner beams 120 by a first fastening member 161.

In particular, in the case of the present embodiment, since a module called connector 130, which is simple but is efficient, is applied, it is possible to reduce the construction process, thereby reducing the construction time and lowering the construction cost.

The connector 130 may include a corner head 131 which is disposed in a corner area between the pair of inner beams 120 and a pair of inclined legs 132, each of which is obliquely extended from the corner head 131 and disposed on inner surfaces of the pair of inner beams.

In the present embodiment, the corner head 131 has a quadrilateral shape, i.e., a diamond shape, but its shape does not limit the claims of the present invention.

In the corner head 131, a first through-hole 131*a* is formed for coupling with an external finishing material 150. Through the first through-hole 131*a*, a screw may be fastened inside the dome.

Accordingly, since the present embodiment provides a structure and a connection structure body, in which the external finishing material 150 is connected to the connector 130, the construction process of the dome-shaped house may be remarkably reduced. In addition, since the external finishing material 150 may be easily replaced, the range of choice of the external finishing material 150 may expand.

On the inclined legs 132, a plurality of the second through-holes 132*a* are formed for coupling the first and the second fastening members 161, 162.

As enlarged in FIG. 3, the connector 130 may include an injection-molded body 130*a* which is injection-molded with a synthetic resin; and a coating layer 130*b* which is coated on the outer surface of the injection-molded body 130*a*. Accordingly, since the connector 130 has a structure and a structure body which are generally injected with synthetic resins, it has an advantage of being simple to treat and easy to handle.

Meanwhile, an outer appearance of the connector 130 may be the same as in FIGS. 3 and 4. In this case, however, the shape or the volume of the corner head 131, the length of the inclined legs 132, and the angle between them may be changed at any time. Therefore, the shape of drawing does not limit the claims of the present invention.

A pair of outer beams 140 is disposed on the outer surface of a pair of inner beams 120 to be connected with the connector 130 and the inner beams 120 by the second fastening member 162. Although the outer beams 140 also use a rectangular cross-sectional beam as in the inner beams 120, a circular or an elliptical beam may also be used.

The external finishing material 150 is a finishing panel which is disposed outside the triangular unit module 110 and fixed outside the triangular unit module 110 through the connector 130. When the external finishing material 150 is fixed on the outside of the triangular unit module 110 through the connector 130 as in the present embodiment, the external finishing material 150 may be easily replaced.

Therefore, when the external finishing material 150 is damaged, since it is not only simple to replace but also easy to replace with other finishing materials, it may enhance the beauty of the outer appearance of the dome-shaped house.

Particularly, unlike a conventional connector connection method, it is simple and easy to assemble and construct the geodesic dome-shaped house with a connector manufactured by molding glass fiber, FRP resin, cement mortar, flat iron, etc. into a mold in the present embodiment.

Hereinafter, referring to FIGS. 5 to 10, a method of constructing the geodesic dome-shaped house will be described.

First, a triangular unit module 110 as shown in FIG. 5 is prepared and a pair of inner beams 120 is disposed on both sides thereof as shown in FIG. 6. Thereafter, the connector 130 is disposed in a corner area between the pair of inner beams 120 as shown in FIG. 7 to fasten the first fastening member 161 as shown in FIG. 8. In this case, the nut has not been yet fastened in the end of the first fastening member 161.

Next, a pair of outer beams 140 is disposed on the outer surface of the pair of inner beams 120 as shown in FIG. 9 and then, fastens the second fastening member 162 to fix the connector 130, the pair of inner beams 120, and the pair of outer beams 140 as shown in FIG. 10.

Thereafter, the external finishing material 150 is disposed on the outer surface of the triangular unit module 110 to construct the geodesic dome-shaped house in a manner of connecting through the connector 130 as shown in FIG. 11.

According to the present embodiment providing the structure and connection structure, and the operation thereof as described above, since a simple and compact connector 130 is used, the construction process may be reduced, thereby reducing the construction time and lowering the construction cost, and further expanding the range of the choice of the external finishing material 150.

FIG. 12 is a front view of the connector which is used to the construction structure of geodesic dome-shaped house according to the second embodiment of the present invention.

Referring to this drawing, the connector, which is used to the construction structure of geodesic dome-shaped house according to the present embodiment, also may include the corner head 231 disposed in a corner area between the pair of inner beams 120 (see FIG. 8) and the pair of inclined legs 232, each of which is obliquely connected in the corner head 231 to be disposed on the inner surface of the pair of inner beams 120.

In the present embodiment of the structure and connection structure, the corner head 231 has the above-described rectangular shape, i.e. a triangle shape other than a diamond shape. Even if the connector 230 having such a structure and a connection structure body is used, the effect of the present invention may be provided.

Even if the present embodiment is applied, since the simple and compact connector 130 is used, the construction process may be reduced, and thus the construction time may be reduced and the construction cost may be lowered, and further the range of choice of the external finishing material 150 (see FIG. 1) can be expanded.

FIG. 13 shows a perspective view of a connection structure body of geodesic dome-shaped house according to the embodiment of the present invention. FIG. 14 is a connecting device installation example of the geodesic dome-shaped house connection structure, and FIG. 15 is a connecting device installation example of the geodesic dome-shaped house connection structure body. Referring to FIG. 13, the present invention includes a connecting device 600, an angle 700, a fastening device 300, an inner material 400, and a finishing panel 500.

First, the connecting devices 600 are arranged in such a manner that a plurality of the connecting devices are spaced apart by a predetermined distance in accordance with the shape of dome which is the outer appearance of a dome-shaped house. The connecting device 600 may have various shapes such as a hexagonal shape in FIG. 2 and a pentagonal shape in FIG. 15 depending on the number of connected angles 700.

The connecting device 600 may include: an upper portion 620 in which a plurality of triangular unit modules are formed continuously along the side surfaces thereof to form a polygonal structure, a center of which is upward and the edge thereof is downward; a stepped portion 640 which is extended to be stepped downwardly along the edge of the upper side portion 620 to be in close contact with the edge portion of the cover plate 520 of the finishing panel 520; a lower side portion 660 which is formed corresponding to the lower portion of the upper side portion 620; and a side portion 680 which is connected to an edge between the stepped portion 640 and the lower side portion 660 to form a groove in a size corresponding to the end of the angle to be in close contact with the angle.

The reason why the upper side portion 620 is formed angularly by the triangular unit module is to reinforce the rigidity by making the connecting device 600 angular rather than making it plane. The reason why the rigidity of connecting device 600 is reinforced is that the connecting device is connected to the angle 700 and the load on the tension and compression is applied. Accordingly, it is preferable that the angular corner is connected with the angle 700 in the same line.

Here, the single stepped part 640 serves to support the finishing panel 500, and the side surface portion 680 serves to be in close contact with the angle 700. In this case, a groove in close contact with the angle is formed on the side surface portion 680. The groove is formed in a rectangular shape and recessed in an inward direction, into which a portion of the angle 700 is inserted, and thereby to facilitate the position of connecting the angle 700 to the connecting device 600.

In addition, the lower side portion 660 is formed in a shape corresponding to the upper side portion 620, the center of which is formed as a plane having a through-hole so that it can mount the nut 662, an anchor nut, or a hexagon nut. In this way, the inner structure may be fitted to the lower side portion 660 with a bolt. Here, the internal structure may be fitted with a thermal insulation material. In addition, the connecting device 600 may be integrally formed by injecting molten liquid into the upper side portion 620, the stepped portion 640, the lower side portion, and the side surface portion 680 by a molding die.

The angle 700 connects the connecting devices 600. The angle 700 is disposed between each of the connecting devices 600 to connect the adjacent connecting devices 600, the upper portion of which is opened.

That is, the angle 700 is provided with a horizontal plate at the lower portion thereof and a vertical plate which is extended to both sides of the horizontal plate in the vertical direction so that a U-shaped channel with internal empty space can be used. In addition, by further forming a bent plate which is bent in an inward direction on both sides of the horizontal plate, there is an effect of preventing the inner material 400 from separating to the outside by the engagement of the bent plate after the inner material 400 is filled to the inside the angle 700.

The fastening device 300 is a fastening member for connecting the connecting device 600 with the angle 700.

Here, the fastening device 300 is provided so that the connecting device 600 and the angle 700 can be easily fixed to each other by using bolts and nuts.

More specifically, the fastening device 300 includes a long nut 320 which is protrudingly coupled to a side surface of the connecting device 600, a mounting plate 340 coupled to both ends of the angle 700, and a bolt 360 installed on each of the mounting plate to connect the connecting device 600 with the angle 700 by fastening with the nut 320. Here, the nut 320 is protruded from a side surface portion of the connecting device 600 with a hexagonal nut having a long length so that slippage can be suppressed by rotating the bolt 360. The nut 320 may be an anchor nut instead of a hexagon nut.

Meanwhile, the nut 320 can be radially connected with the molding mold of the connecting device 600 when injecting the connection device 600 such that the connection device is injected with the nut 320 being connected thereto, and further the nut to be connected to the lower part can be also connected to the connection device in the same way. The mounting plate 340 has a hole through which the bolt 360 passes at the center and is welded to be fixed on both ends of the angle 700.

The mounting plate 340 is further provided with a guide plate 342 on both sides, which is in close contact with the inner side of the angle 700 and is guided when inserted, thereby facilitating the bonding of the mounting plate 340 to the angle 700 to be welded easily.

The above inner material 400 is configured to couple the finishing panels 500.

The inner material 400 is provided inside the angle 700, and the coupling groove 420 is formed on the upper part. The coupling groove 420 of the inner material 400 is formed to be long in the upper portion along the longitudinal direction of the angle 700 and are formed as a pair. They are formed as a pair because the finishing panels 500 are coupled at both sides. Here, it is preferable to select the inner material 400 which is lighter than the above angle 700 for lightening the dome-shaped house. Considering that the finishing panels 500 are inserted into the coupling groove 420, it is preferable to use an elastic resin-based material in order to facilitate coupling.

Therefore, the framework of the dome-shaped house can be formed by the structure of the connecting device 600, the angle 700, the fastener 300 and the inner material 400.

The finishing panel 500 is a configuration regarding the exterior of the dome-shaped house.

The finishing panel 500 may finish a space between the adjacent above angles 700. Specifically, the finishing panels 500 consists of a cover plate 520 located in a space between the adjacent above angles 700 and an insertion plate 540 provided under the above cover plate 520 and inserted into the coupling groove 420 of the inner material 400. In the present invention, the dome-shaped house can be easily assembled and finished by assembling the angle 700 to the connecting device 600 by a fastening device 300 to form a shape and finally simply inserting and coupling the finishing panel 500 into the inner material 400 included in the angle 700.

It is preferable that the finishing panels 500 are coupled to both sides of the finishing material 400 of the angle 700 and the area between the finishing panels 500 is finished with silicon to be waterproofed. As described above, the present invention is based on providing the connecting structure of a geodesic dome-shaped house as a basic technical idea, and it is obvious that many other variations are possible for those of ordinary skill in the pertinent art in the industry within the scope of the basic idea of the present invention.

It is obvious to those of ordinary skill in the pertinent art that the present invention is not limited to the stated embodiment, but can be modified and transformed diversely without departing from the idea and scope of the present invention. Therefore, it can be said that such modifications or variations are within the Scope of a request of the present invention.

The invention claimed is:

1. A construction structure of a geodesic dome-shaped house, comprising:

a plurality of triangular unit modules constituting a unit structure and a connection structure body of the geodesic dome-shaped house;

a pair of inner beams disposed on opposing sides of each of the plurality of triangular unit modules;

a connector provided with a corner head which is disposed in a corner area between the pair of inner beams and a pair of inclined legs, wherein each of the inclined legs of the pair of inclined legs is obliquely extended from the corner head and disposed on inner surfaces of the pair of inner beams configured to be connected to the pair of inner beams by a first coupling member;

a pair of outer beams disposed on outer surfaces of the pair of inner beams, respectively and connected with the connector and the pair of inner beams by a second coupling member; and an exterior finishing material disposed on an outside of each of the plurality of triangular unit modules to be replaced and fixed to the outside of each of the plurality of triangular unit modules through the connector.

2. The construction structure of the geodesic dome-shaped house according to claim 1, wherein the corner head of the connector is in a shape of a rectangle or a triangle, and is formed with a first through-hole for coupling with the exterior finishing material, and the pair of inclined legs are formed with a second through-hole for coupling with the first and the second coupling members.

3. The construction structure of the geodesic dome-shaped house according to claim 1, wherein the connector comprises an injection-molded body which is injection-molded with a synthetic resin; and a coating layer which is coated on an outer surface of the injection-molded body.

4. A connection structure body of a geodesic dome-shaped house, comprising:

a plurality of connecting devices each spaced apart by a predetermined distance to form a shape of the geodesic dome-shaped house;

a plurality of angles each disposed between each of the connecting devices;

a fastening device configured to fasten and connect the each of the plurality of angles to the connecting devices; and a finishing panel provided with a cover plate placed in a space between the plurality of angles adjacent to an inner material which is provided inside each of the plurality of angles with a coupling groove formed thereon and an insertion plate which is provided at a lower portion of the cover plate to be inserted into the coupling groove, wherein each of the plurality of angles comprises a horizontal plate, a vertical plate which is extended in a vertical direction on sides of the horizontal plate, and a bent plate which is bent downward at an end of the vertical plate to prevent the inner material from being separated.

5. The connection structure body of the geodesic dome-shaped house according to claim 4, wherein the fastening device comprises:

a nut which is protrudingly coupled to a side surface of each of the connecting devices; and a mounting plate coupled to ends of each of the plurality of angles, and a bolt installed on the mounting plate to connect each of the connecting devices with each of the plurality of angles by fastening with the nut.

6. The connection structure body of the geodesic dome-shaped house according to claim 5, wherein the mounting plate further comprises a guide plate which is extended from the mounting plate and in contact with an inner side surface of an angle of the plurality of angles.

7. The connection structure body of the geodesic dome-shaped house according to claim 4, wherein each of the connecting devices comprises:

an upper side portion in which a plurality of triangular unit modules are formed continuously along side surfaces thereof to form a polygonal structure, a center of which is upward and an edge thereof is downward;

a stepped portion which is extended to be stepped downwardly along an edge of the upper side portion to be in contact with an edge portion of the cover plate;

a lower side portion which is formed adjacent to a lower portion of the upper side portion; and a side portion which is connected to an edge between the lower side portion and the stepped portion to form the coupling groove.

8. The connection structure body of the geodesic dome-shaped house according to claim 4, wherein the inner material is formed of a waterproof material.

* * * * *